United States Patent [19]

Yamaguchi

[11] 4,147,271

[45] Apr. 3, 1979

[54] DRAWN AND IRONED CAN BODY AND FILLED DRAWN AND IRONED CAN FOR CONTAINING PRESSURIZED BEVERAGES

[75] Inventor: Hisakichi Yamaguchi, Ashiya, Japan

[73] Assignee: Daiwa Can Company, Limited, Tokyo, Japan

[21] Appl. No.: 808,738

[22] Filed: Jun. 22, 1977

[30] Foreign Application Priority Data

Aug. 20, 1976 [JP] Japan ..... 51-99296

[51] Int. Cl.[2] ..... B65D 7/42

[52] U.S. Cl. ..... 220/70; 220/66

[58] Field of Search ..... 220/66, 70, 1 BC, 269, 220/67; 113/120 H

[56] References Cited

U.S. PATENT DOCUMENTS

| | | | |
|---|---|---|---|
| 2,971,671 | 2/1961 | Shakman | 220/66 |
| 3,288,342 | 11/1966 | Tinker | 220/67 |
| 3,394,837 | 7/1968 | Hansen et al. | 220/270 |
| 3,409,167 | 11/1968 | Blanchard | 220/66 |
| 3,603,275 | 9/1971 | Eickenhorst et al. | 113/120 H |
| 3,878,963 | 4/1975 | Knize | 220/66 |
| 3,904,069 | 9/1975 | Toukmanian | 220/70 |
| 3,973,693 | 8/1976 | Brocklehurst | 220/70 |
| 3,979,009 | 9/1976 | Walker | 220/70 |
| 3,998,174 | 12/1976 | Saunders | 220/70 |

FOREIGN PATENT DOCUMENTS

| | | | |
|---|---|---|---|
| 555872 | 4/1957 | Belgium | 220/67 |
| 969114 | 6/1975 | Canada | 220/70 |
| 488427 | 7/1938 | United Kingdom | 220/1 BC |

*Primary Examiner*—William Price
*Assistant Examiner*—Allan N. Shoap
*Attorney, Agent, or Firm*—Watson, Leavenworth, Kelton & Taggart

[57] ABSTRACT

A drawn and ironed can body with integral bottom and a drawn and ironed can seamed with a top closure at the opening end are designed for packaging pressurized beverages and made of a sheet material thinner than that heretofore used for conventional drawn and ironed cans, and the top closure and the bottom resist buckling as might be caused by the actual internal pressure produced therein.

7 Claims, 25 Drawing Figures

FIG.1
PRIOR ART
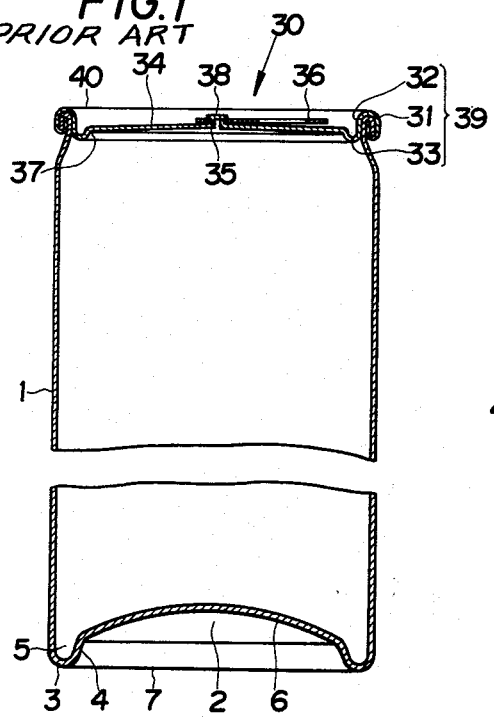
FIG.4
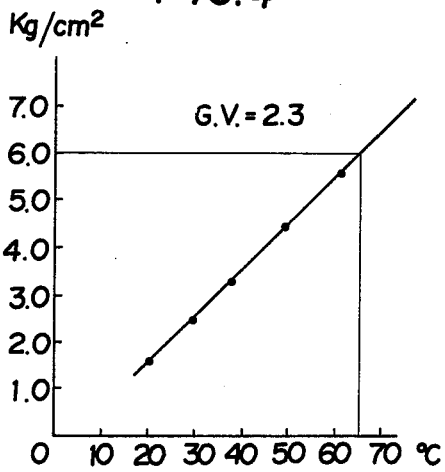
FIG.2
PRIOR ART
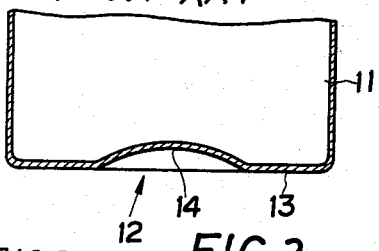
PRIOR ART FIG.3
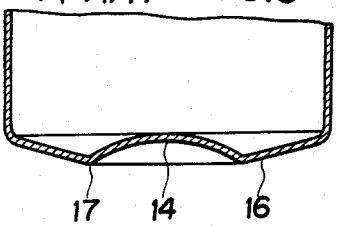
FIG.5
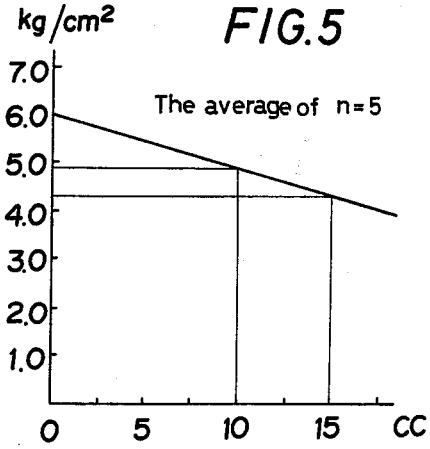

DRAWN AND IRONED CAN BODY AND FILLED DRAWN AND IRONED CAN FOR CONTAINING PRESSURIZED BEVERAGES

BACKGROUND OF THE INVENTION

1. Field of the Invention

This invention relates to a cylindrical can body formed by ironing the side wall of a cup which has been produced by drawing a metal disc (hereinafter called a D&I can body) and also relates to a filled D&I can, filled with beverage under pressure and generating or exerting positive internal pressure in the can (hereinafter called internal pressure), for example, beer, carbonated beverages, etc., such can body being seamed with a metallic top closure (hereinafter called a D&I can).

2. Description of the Prior Art

A top closure of a conventional D&I can now available on the market has, in sequence from the outermost edge of said closure as shown in FIG. 1, a seamed portion 31, a countersunk portion 32 which extends almost parallel to the side wall of the can body, a bead portion 33 which continues from said countersunk portion 32 (portion 31, 32 and 33 constituting an outer peripheral portion 39 of the top closure), a central portion 34 of the top closure which extends from and is surrounded by said bead portion 33 beyond a small curved portion 37, said central portion 34 being slightly domed upwardly and staying inside of the can end plane 40 (the meaning of can end plane is defined hereinafter) and a ready tearing and opening tab 36 fixed to the center of said central portion 34 with a rivet 35 (normally termed an easy opening top closure), and the D&I can body of said D&I can has a bottom 2 which comprises an outer peripheral portion 5 having a semi-circular inwardly turning portion 3 which turns upwardly from the lower end of the straight side wall 1, an inclined wall 4 which extends upwardly from said turning portion 3, and a high domed central portion 6 which is an extension of and is surrounded by said inclined wall and which in whole stays inside of the can end plane 7.

When such shape of the bottom of this D&I can body is used for a beer can, for example, it does not suddenly distend into an outwardly projecting shape (namely, does not buckle) at the inwardly turning portion 3 and inclined wall 4 under the internal pressure exerted within same by the pressure produced in the beer-filled bottle during the pasteurizing process, while the domed central portion 6 of said bottom is most resistant to deformation by the internal pressure because it is structural-dynamically provided with such buckling resistant strength as prevents deformation of the entire bottom wall (the buckling resistant strength of the top closure and the bottom with such profile as aforementioned being obtainable by using adequate dimensions and wall thickness of said bottom) until it buckles.

The other type of bottom of conventional D&I can bodies comprises, as illustrated in FIG. 9, a turning portion 73 which turns sharply at the lower end of the straight side wall 71 of said D&I can body, inclined wall 74 which connects to said turning portion 73 and extends upwardly (73 and 74 constituting a bottom peripheral portion 77), a second turning portion 79 which turns sharply at the upper end 78 of said inclined wall 74, inclined inner wall 76 which is an extension of said second turning portion 79 and extends downwardly, and a flat portion 75 which is connected to said inclined inner wall 76 and stays inside of the can end plane 81 (75 and 76 constitute a dish-shaped central portion 80), and is provided with buckling resistant strength which is the same as that of the bottom of the can illustrated in FIG. 1 which prevents deformation when subjected to the internal pressure, said buckling resistant strength of the bottom with aforementioned profile being achieved by using adequate dimensions and wall thickness of said bottom.

Conventional beer-filled D&I cans having the bottom illustrated in FIG. 9 and a diameter of approximately 65 mm comprises a D&I can body made of 0.40mm thick aluminum alloy sheet and an easy opening top closure seamed thereto.

The bottom and top closure of any one of the conventional D&I cans illustrated in FIGS. 1 and 9 are provided with such buckling resistant strength as withstands the maximum allowable pressure for a bottle which is the average pressure calculated by measuring the positive internal pressure in a plural number of bottles filled with pressurized beverage such as beer and heated to the specified maximum temperature, plus a safety pressure value, and thus do not buckle, and in particular, the bottom is so constructed as to undergo little if any deformation. However, it has been observed that the top closure of the conventional D&I can distend outwardly when an internal pressure is generated therein, which results in increasing the volume of the can and consequently presumably makes the internal pressure lower than that in a bottle. If so, a D&I can need only be provided with such buckling resistant strength as withstands that reduced internal pressure, but no conventional D&I can has ever adopted such concept and the bottom wall and the top closure wall are actually made thicker and stronger than necessary.

Considering the fact that an enormous number of D&I cans for pressurized beverages are consumed per year and the consumption is increasing year by year, even a slight reduction of the amount of material used per can would greatly contribute to conservation of resources including raw and finished materials and the energy employed for producing the same. A D&I can body of reduced weight is disclosed in the U.S. Pat. No. 3,904,069. This D&I can body, as shown in FIG. 2, comprises a side wall 11, a flat annular panel portion 13 which intersects said side wall 11 at right angles and forms the outer peripheral portion of the bottom portion 12 and a domed central portion 14 which is surrounded by said flat annular panel portion 13, and is provided with such buckling resistant strength as substantially inhibits the domed central portion 14 from distending outwardly while and when the flat annular panel portion 13 deforms into a conical shape as shown in FIG. 3 when subjected to an internal pressure of up to 6.3kg/cm$^2$ (90 p.s.i.) for beer and 6.7kg/cm$^2$ (95 p.s.i.) for pressurized gas-containing beverage, said buckling resistant strength being obtainable by using adequate dimensions and thickness of the bottom wall. This can body has an advantage that the amount of material required for a unit of this can body is less than that for said conventional D&I can body, which means that a can body with the same volume at that of a coventional D&I can body can be obtained using a smaller quantity of material, because the domed central portion of the bottom wall of this can body is made smaller than that of said conventional D&I can body so as to allow such a distension of the bottom as shown in FIG. 3, which enables this can body to keep the internal volume the same as that of a conventional D&I can body with smaller area of overall can body and also enables the bottom wall to be made thinner than that of conventional D&I can body while keeping the same buckling resistant strength, and it is estimated that approximately 15% reduction in the weight of the can body was realized. No particular form of top closure is disclosed as being used for the D&I can body in the specification of this U.S. Patent. However, the can body of this patent can keep upright standing only in a comparatively unstable condition since the flat annular panel portion 13, once deformed into the conical shape as described above, generally maintains its shape even at normal temperature ("normal temperature" being defined hereinafter) without restoring its original shape (FIG. 2) with the result that when placed in an upright position on the table or the like, it sits on the bottom ridge 17 of the cone shape which is smaller in diameter than that of the outer peripheral portion of the bottom shown in FIGS. 1 and 9. Furthermore, the bottom wall of the D&I can body covered by this U.S. Patent still has a buckling resistant strength as in the case of the D&I can bodies in FIGS. 1 and 9 which withstands the maximum pressure in a bottle described hereinbefore, which magnitude of buckling resistant strength is not required principally because no attention is given to the increased internal volume caused by the distension of the bottom and the consequent reduction in the internal pressure. This means that the bottom wall thickness is still greater than necessary.

SUMMARY OF THE INVENTION

The primary object of the present invention is to provide a D&I can body and a D&I can which are different from conventional D&I can bodies and the D&I can as shown in FIGS. 1, 2 and 9, said can body and can having a bottom (or a bottom and top closure) with a central portion which distends under internal pressure, the wall of the said bottom (or said bottom and top closure) being made thinner than that of conventional can body or can and an outer peripheral portion provided with such buckling resistant strength as withstands the internal pressure which decreases by the increase of internal volume resulting from distension by the internal pressure thereby allowing a stable upright standing at normal temperature. This and other objects and advantages of the present invention will become apparent from the following detailed description and accompanying drawings wherein preferred embodiments are shown.

BRIEF DESCRIPTION OF THE DRAWINGS

FIG. 1 is a partially cutaway elevational view of a conventional D&I can shown in section.

FIG. 2 is an elevational view of the bottom and its vicinity of a known type D&I can body of reduced weight as shown in section.

FIG. 3 is an elevational view in section showing the distension of the known can bottom shown in FIG. 2 due to internal pressure.

FIG. 4 is a graphic display of the correlation between the temperature and the internal pressure in a bottle filled with beer having a 2.3 G.V.

FIG. 5 is a graphic display of the correlation between the pressure and the increase of internal volume in a sealed container containing beer at 65° C.

DETAILED DESCRIPTION OF THE INVENTION

The present invention was established based on the findings resulted from the following two experiments.

Figure 9:
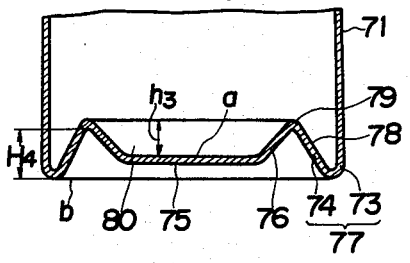
FIG.9 PRIOR ART
FIG. 9 is a cross sectional elevation showing the profile of a bottom in another example of a known form of can.

One of those two experiments was undertaken to determine the precise relationship between the change of pressure as occurs in a can when the volume changes and has proven that as the internal volume of a container filled with pressurized beverage and sealed is increased at a certain temperature, the internal pressure in said container becomes lower than that in said container before the internal volume is increased. From this experiment, it has been confirmed that the internal pressure in a conventional D&I can should be lower than that in a bottle which internal volume does not increase, because the top closure of said conventional D&I can should distend due to the internal pressure, and therefore the top closure and bottom wall of said conventional D&I can which withstands the same internal pressure as in a bottle have excessive wall thickness, and that the internal pressure in a D&I can having such bottom outer peripheral portion as shown in FIGS. 1 and 9 and bottom central portion which largely distends due to the internal pressure should be lower than that in such D&I can as shown in FIGS. 1 and 9 with a bottom central portion which hardly distends, and therefore the thickness of top closure and bottom wall of a D&I can with a central portion which largely distends due to the internal pressure could be reduced, and thereby said D&I can should be lighter than said conventional D&I can.

The other experiment has proven that, in the case that either the top closure or the bottom of a can buckles and the other does not buckle when said can is filled with pressurized beverage and heated up to a specified temperature, said top closure and bottom having respectively a central portion which distends due to the internal pressure, it is possible to make either the top closure or the bottom that buckles free from buckling by reducing the internal pressure through attenuation of the other that does not buckle, thereby providing that neither the top closure nor the bottom will buckle at the said specified temperature.

From this experiment, the following has been confirmed; in the course of reducing wall thickness of a top closure and a bottom of a D&I can to such an extent that further attenuation would cause buckling of them at a specified temperature, the profiles and the dimensions of the top closure and the bottom being giving respectively, either the top closure or the bottom may buckle while the other may not buckle because of difference of profile and dimensions between the top closure and the bottom. In that case it should be possible to bring the internal pressure down below the buckling resistant strength of either the top closure or the bottom that buckles by attenuating the other that does not buckle in order to make it distend to a greater degree so that neither the top closure nor the bottom buckles. Thus, a D&I can having the thinnest top closure and bottom walls with nearly equal buckling resistant strength should be obtained.

Definitions of the terms used herein are given below. "Can end plane" means an imaginary plane touching the top or bottom ridge of the can and intersecting the longitudinal axis of the can at right angles. "Inwardly" means a direction along the longitudinal axis from one end of the can toward the other end of the can and "outwardly" means the reverse direction. "Displacement" means the shift of a point on an end wall surface when distended, such shift being parallel to the longitudinal axis of the can. "Buckling" is an abrupt outward deformation of a part or whole of any inwardly directed portion of the bottom or top closure, for example, a sudden deformation of the peripheral portion of the can bottom, the occurrence of which diminishes or prevents the can from being placed or stacked standing in a stable upright position. "Buckling resistant strength" means the strength expressed in the minimum pressure value that causes buckling, and the buckling resistant strength of the bottom and top closure changes with the change of any of its profile, dimensions, wall thickness and the quality of the material used.

Some types of D&I can bodies and top closures are mass-produced, i.e., large quantities of D&I can bodies and top closure of same specifications are produced in many production lines using materials of the same specifications at a rate of several hundreds of cans and several hundreds of top closures per one production line per minute, but materials of the same specifications are not always completely uniform in thickness, having a tolerance of ±0.01mm for aluminium alloy sheet and ±0.5% for tinplate. The quality of the material also varies within a specified range, and likewise there are variations in the clearance between the parts incorporated in manufacturing machines and the quantity of lubricant to be applied thereto, and accordingly dimensions and the buckling resistant strength of the can bottoms and the top closures are not free from variation despite similarity in profile. For example, referring to FIG. 12 which depicts the profile of a bottom of a D&I can body, the bottom comprises the first curved turning portion 83 which is an extension of the lower end of the straight side wall 81, the inclined wall 84 which extends upwardly in the direction of the can longitudinal axis, the second curved turning portion 85 which is an extension of the top of said inclined wall 84 (83, 84 and 85 mentioned above constituting the bottom peripheral portion 82), and the bottom central portion 86 which is an extension of the peripheral portion, said central portion 86 comprising the annular flat portion 87 and the central dome portion which is surrounded by said annular flat portion and formed into a small shallow dome. When a can body having such bottom construction is manufactured from an aluminum alloy sheet with thickness of 0.34mm, the height $H_o$ of the peripheral portion of the bottom from the can end plane b of this bottom to the outer surface at peak of the second curved turning portion 85, the height So of the central portion from the can end plane b to the outer surface of the annular flat portion 87 of the central portion, the buckling resistant strength of the bottom wall, the mean value $\overline{X}$ of the can body and weight and the value of deviation $\sigma$ are shown below.

$\sigma = 0.0060$mm where $\overline{X}$ of the height of Ho of the peripheral portion equals 6.729mm.

$\sigma = 0.0149$mm where $\overline{X}$ of the height So of the central portion equals 3.098mm.

$\sigma = 0.080$ kg/cm$^2$ where $\overline{X}$ of the buckling resistant strength equals 5.48 kg/cm$^2$.

$\sigma = 0.0474$ gr.

where $\overline{X}$ of the can body weight equals 12.224 gr.

Figure 12:
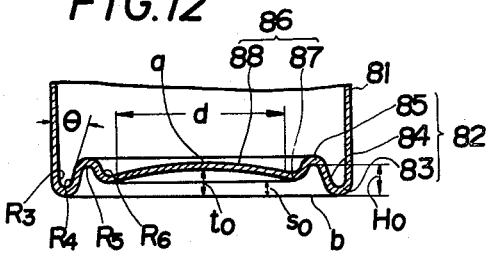
FIG. 12 is a cross sectional elevation showing the profile of a bottom adopted to another example of the present invention.

In the case of a can body made of 0.39mm thick aluminum alloy sheet with bottom having a profile the same as shown in FIG. 12.

$\sigma = 0.0053$ mm where $\overline{X}$ of the height Ho of the peripheral portion equals 6.723mm.

$\sigma = 0.0076$mm where $\overline{X}$ of the height So of the central portion equals 3.106mm.

$\sigma = 0.0735$ kg/cm$^2$ where $\overline{X}$ of the buckling resistant strength equals 6.53 kg/cm$^2$.

$\sigma = 0.0492$ gr.

where $\overline{X}$ of the can body weight equals 12.725 gr.

The above cited examples show that mass-produced cans, though of the same specifications, have variations of height So of the central portion between 0.05 to 0.09mm and of buckling resistant strength by approximately 0.5 kg/cm$^2$. For example, a can body having a nominal buckling resistant strength of 5.5 kg/cm$^2$ has an actual buckling resistant strength ranging from 5.25 to 5.75 kg/cm$^2$. Therefore, "nearly equal buckling resistant strength" of the bottom wall and the top closure wall of a can means that the respective mean values of the buckling resistant strength of the bottom wall and the top closure wall are nearly equal, and the meaning of a can having the bottom wall and the top closure wall of nearly equal buckling resistant strength is that both the bottom and the top closure have buckling resistant strengths within the respective variation range.

The "specified maximum temperature" is the maximum temperature specified by canners for pasteurization of the canned pressurized gas-containing beverage. In the case of beer, for example, it is the temperature during the pasteurizing process specified by canners; in the case of carbonated gas-dissolved beverage, the temperature specified by the canner is based on the temperature to which the can filled with the beverage is to be exposed after filling and before ultimate use, and in the case of carbonated fruit juice, it is the temperature during the pasteurizing process specified by the canner.

"Normal temperature" is the temperature in a normal state without any cooling or heating, e.g., ambient temperature of a store shelf area. The aforementioned first novel finding which formed the basis of the present invention will now be described in detail below.

FIG. 4 is a graphic display of the correlation between the temperature of bottled beer and the internal pressure in a bottle. It shows that the internal pressure in a bottle filled with beer of 2.3 gas volume (hereinafter abbreviated as G.V.) is approximately 6.0 kg/cm$^2$ at 65° C., which is the pasteurization processing temperature of beer. The can disclosed in the aforementioned U.S. Pat. No. 3,904,069 has a bottom which is provided with such a buckling resistant strength as to resist buckling of said bottom under the internal pressure of 6.0 kg/cm$^2$ at the pasteurization processing temperature plus an extra safety pressure of 0.3 kg/cm$^2$. The inventor of the present invention obtained the graph shown in FIG. 5 through experiments carried out on the assumption that when the internal volume of a sealed container filled with pressurized gas-containing beverage (e.g. beer) and sealed is increased, with the temperature of the beverage being kept constant, the gas dissolved in the beverage may be discharged into the increased space in the container, which reduces the internal pressure in the container to less than that, e.g., as would be present in a bottle which maintains its internal volume unchanged. This graph shows the change of the internal pressure in a container with a capacity of 383ml. filled with 360ml. of beer with 2.3 G.V. and sealed in a normal method as the internal volume of the container is increased while the temperature of the beer is kept at 65° C. As shown in the graph, when the internal volume is increased by 10ml., the internal pressure decreases by approx. 1.0 kg/cm$^2$ compared with that before the internal volume is increased, and when the internal volume is increased by 15ml., the internal pressure decreases by approx. 1.5 kg/cm$^2$.

The following experiment has also proven that an increase of the internal volume of a can after it is sealed causes a decrease of the internal pressure. A D&I can body having a bottom as shown in FIG. 2 was formed of a 0.33mm thick aluminum alloy sheet to the following dimensions. The diameter of this D&I Can body was approx. 65mm, the diameter of the domed central portion 14 of the bottom was approx. 35mm, the thickness of the side wall was approx. 0.13mm and the thickness of the bottom wall was 0.33mm which was the same as that of the material sheet. This D&I can body was filled with approx. 360ml of beer and seamed with an easy opening top closure with thickness of 0.31mm as shown in the aforementioned FIG. 1. (The internal volume of the can seamed with the top closure was approx. 383ml.) The internal pressure of this can immediately after it was heated up to 65° C. for pasteurization was approx. 5.25 kg/cm$^2$ (in the case of a bottle, the internal pressure is 6.0 kg/cm$^2$ under the same conditions), and the central portion of the bottom distended downwardly by approx. 5mm of displacement, while the central portion 38 of the top closure (FIG. 1) distended upwardly by approx. 2.2mm of displacement. This can body was made of sheet material 0.025mm thinner than the material for the can body covered by the aforementioned U.S. Pat. No. 3,904,069 which is 0.355mm thick, neither the domed central portion 14 nor the top closure had buckled in the said pasteurizing process although only the annular portion 13 distended downwardly as shown in FIG. 3. From such experimentation it was confirmed that, in the case of a can filled with pressurized gas-containing beverage such as beer, its internal pressure becomes less than that in a bottle, because the internal volume of the can increases through distension due to the internal pressure produced in the can after it is filled with said beverage, sealed, and heated to the specified maximum temperature while the bottle, when filled with said beverage, capped and heated to the same temperature, does not distend and therefore the internal volume and internal pressure remain unchanged.

It can then be concluded that a reduced buckling resistant strength need only withstand the said reduced internal pressure should be sufficient, and such strength is obtainable by properly engineering the necessary profile, dimensions and wall thickness of the bottom and top closures. The above is the first finding which formed the basis of the present invention.

Figure 6:
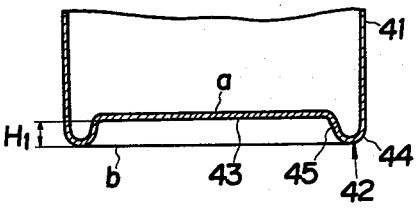
FIGS. 6, 7, and 8 are cross sectional elevations showing the basic profile of the bottom of a can of this invention, showing in particular, the basic profile of the central portion.
Figure 7:
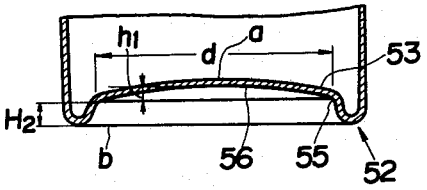
Figure 8:
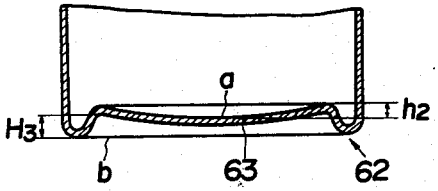

Further experiment was carried out to investigate whether or not the central portion of the bottom of the conventional D&I can bodies shown in FIGS. 1 and 9 will distend at the internal pressure in the cans, to measure the amount of the distension of the bottom if it distends, and furthermore, to determine the profile of a bottom that distends to a greater degree without causing buckling at the specified internal pressure, than that to which the bottom of a conventional can body may distend. In the experiment, can bodies of six categories were manufactured from an aluminum alloy sheet of 0.4mm in thickness; namely, a can body D with a flattened bottom, in reference to FIG. 6, comprising the outer peripheral portion 42, made up of the annular ridge portion 44 which turns at the lower end of the straight side wall 41 and the inclined wall 45 which is an extension of the annular ridge portion 44 and which rises upwardly at a slant, and the flattened disk-shaped central portion 43 which extends to the outer peripheral portion 42, a can body A with a domed bottom in reference to FIG. 7, which has the outer peripheral portion 52 of the same profile as that of the outer peripheral portion 42 in FIG. 6, and has a central portion provided with the convexly domed central portion 53, and whose height hl from the periphery to the center a of the domed central portion 53 is 6.0mm, can bodies B and C of which the height hl is 1.2mm and 0.8mm respectively and is below 3% of the diameter d of the domed central portion, a can body E with a concavely domed bottom in reference to FIG. 8, which has the outer peripheral portion 62 of the same profile as that of the outer peripheral portion 42 in FIG. 6, and has a concavely domed central portion 63 whose depth h2 at the center of concavely domed central portion is 0.5mm, and a can body F having a bottom of which depth h3 of the dish-shaped portion 80, in reference to FIG. 9, is 2.6mm. Here, the respective heights H1, H2, H3 and H4 of the outer peripheral portion of each can body was so specified that the buckling resistant strength of the outer peripheral portion of each can body was 5.0 kg/cm$^2$.

The diameter of each can body was approximately 66mm. The following table shows the bottom displacement at the center of the central portion where the displacement was the largest, when the can bodies were subjected to an internal pressure of 4 kg/cm$^2$.

| Classification of can bodies | Displacement dimensions (mm) | Remarks |
|---|---|---|
| A : h1 of central portion = 6.0mm | 0.6 | Prior art can body |
| B : h1 of central portion = 1.2mm | 3.2 | |
| C : h1 of central portion = 0.8mm | | |
| D : flattened central portion | 1.8 | |
| E : h2 of central portion = 0.5mm | 1.2 | |
| F : h3 of central portion = 2.6mm | 0.8 | Prior art can body |

Each can body distended very little in the outer peripheral portion and stood in a stable upright position. As a result, it has been proven that among the bodies A to F having the bottoms whose central portions are surrounded by the outer peripheral portions and remain inside of the can end plane when distended, the can bodies B to E whose height or depth h is smaller than that of the can bodies A and F are subject to larger distension and greater increase of the internal volume than the can bodies A and F. Thus, it has been known that the internal pressure of a can reduces as the internal volume of the can increases, and that there are some profiles of the bottom of a can body which permit the central portion to distend under internal pressure in the can while the outer peripheral portion maintains adequate buckling resistant strength.

Described below is an example of a calculation that determines the height of the outer peripheral portion of the bottom (assuming that other dimensions of the bottom are given) and the thickness of the material of a can body of the minimum weight when the diameter and the height of the can body, the material of the can body and the profile of the bottom are given. According to experimentation regarding the present invention, when a can body, whose diameter is approximately 66mm and whose height is approximately 122mm, having a bottom formed into the profile shown in FIG. 10 (which includes the first annular ridge portion 25 which is an extension of the lower end of the straight side wall 21 and forms a part of the outer peripheral portion 22 of the bottom, the inclined wall 26 which extends inwardly and tangentially from said first annular ridge portion 25 and forms another part of the outer peripheral portion 22 of the bottom, the second annular ridge portion 27 which is an extension of the inclined wall 26 and forms the remaining part of the outer peripheral portion of the bottom, and the flat central portion 28 which is surrounded by the second annular ridge portion 27) is manufactured from an aluminum alloy sheet whose thickness is within the range from 0.34mm to 0.39mm, the buckling resistant strength of the outer peripheral portion increases or decreases by 0.28 kg/cm$^2$ on the average when the height H5 of the outer peripheral portion is increased or decreased by 1mm from a standard height of 5.5mm while the thickness of the material remains unchanged, and the buckling resistant strength increases or decreases by 0.23 kg/cm$^2$ on the average when the thickness of the material is increased or decreased by 0.01mm while the height of the outer peripheral portion remains unchanged. In the latter case, the displacement of the center of the central portion at an internal pressure of 5 kg/cm$^2$ decreases or increases by 0.25mm from the original displacement. Such increase or decrease of displacement by 0.25mm causes an increase or decrease of approximately 0.5cc in the internal volume of the can body if a standard displacement is 4mm and the standard diameter d of the central portion is approximately 50mm, and in turn, causes a decrease or increase of 0.05 kg/cm$^2$ in the internal pressure.

When the sheet thickness of the material is decreased by 0.01mm, the resultant decrease in the buckling resistant strength is 0.18 kg/cm$^2$ greater than that occurring in the internal pressure, whereby it becomes necessary to increase the height of the outer peripheral portion by 1mm $\times$ (0.18/0.23) = 0.65mm in order to maintain a relatively adequate buckling resistant strength. Since the increase of 0.65mm in the height of the outer peripheral portion causes an increase of 0.65mm in the height of the bottom central portion, the height of the can body must be increased in order to maintain the internal volume which is given to the can body before the increase in the height of the outer peripheral portion.

The aforementioned increase in the height of the can body and the increase in the area of the bottom due to the increase in height of the outer peripheral portion causes an increase in weight of the can body. In an example in which the thickness of the material was decreased by 0.01mm, the aforementioned increase in weight of the can body was approximately 0.139 gr. On the other hand, another example showed that in a can body having a bottom whose outer peripheral portion and center of central portion were 6.5mm and 3.6mm in height respectively, the weight of the can body increased or decreased by 0.1 gr. when the thickness of the material was increased or decreased by 0.01mm (the thickness of the straight side wall remained unchanged). Considering that the weight of the can body of the present invention, the height of the outer peripheral portion of the bottom of which can body is calculated as aforementioned, also increases or decreases to a similar extent when the thickness of the material is increased or decreased by 0.01mm, the decrease in the thickness of the material of the can body of the present invention by 0.01mm results in an increase of approximately 0.039 gr. (which can is nonetheless still of less weight than a conventional can) in weight because 0.1 gr. out of the aforementioned increase in weight is offset by the decrease of 0.1 gr. On the contrary, an increase in the sheet thickness causes a decrease in the weight of the can body. However, a can using the can body of the present invention with the top closure seamed thereto must sit in a stable upright position at normal temperature, or in other words, the can body must satisfy the condition that the bottom central portion of the can body does not protrude outside the can end plane, from which condition the following formula limitting the range of available wall thickness is derived;

Height of outer peripheral portion $\geqq$ Height of the central portion + displacement dimensions of the center of the central portion.

Figure 10:
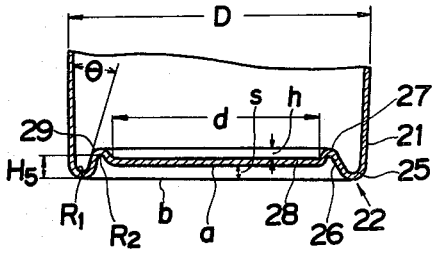
FIG. 10 is a cross sectional elevation showing the profile of a bottom adopted to a specific example of the present invention.
Figure 13:
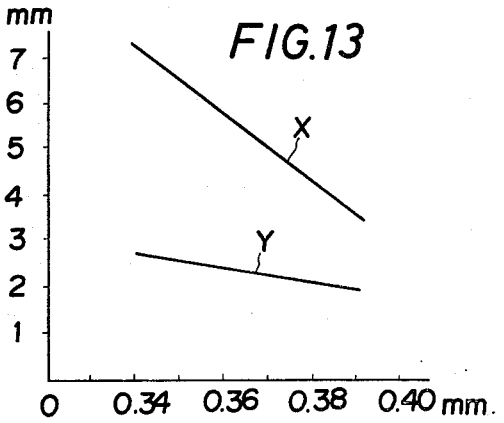
FIG. 13 is a graphic display of the correlation between the height of the bottom peripheral portion and the material sheet thickness, and the correlation between the material sheet thickness and the displacement of the center of the central portion of the bottom at an internal pressure of 2 kg/cm$^2$, the contents being beer at room temperature.

In FIG. 13, the line (X) represents the relationship between the height of the outer peripheral portion of the bottom formed into the profile shown in FIG. 10 and provided with a given buckling resistant strength, and the corresponding thickness of the material, and the line (Y) represents the relationship between the displacement dimensions of the center of the central portion at the internal pressure of 2 kg/cm$^2$ at the aforementioned mornal temperature and the thickness of the sheet material. Since the height of the center of the central portion of the aforementioned bottom is 3.6mm, a sheet thickness of 0.35mm is obtained by locating the point on the line (X) where the distance to the line (Y) in the direction of the vertical axis is close to and greater than 3.6mm. This can body made of 0.35mm thick material showed reduction in weight of approximately 6% compared with the conventional can body which is formed into the profile as shown in FIG. 1 from 0.43mm thick material and provided with the same height and diameter as this can body.

The aforementioned thickness of 0.35mm is the desired thickness to provide a bottom which satisfies the basic data used in the above calculations, which bottom should fulfil all the specific requirements such as necessary buckling resistant strength, the greatest internal volume, and a stable upright standing at a normal temperature. However, the sheet thickness obtained from the above calculations is just one example of the can body and it should be calculated for different types of bottom profile on a case-by-case basis.

In the present invention, the flexibility of the central portion of the bottom (and top closure) and the buckling resistant strength of the outer peripheral portion are provided by using adequate profile, dimensions and wall thickness, and accordingly the bottom and the top closure of the can or the can body of this invention can be embodied using various combinations of said profile, dimensions and wall thickness.

Following is the detailed description on the second finding which led to the present invention. The aforementioned sheet thickness of 0.35mm was calculated without considering the relation with a top closure, and according to the second finding which led to the present invention, the increased internal volume of the can, as caused by the distension of the bottom wall of the can body, affects reduction of the wall thickness of the top closure, and therefore the wall thickness of the bottom must be determined with this factor in mind.

D&I can bodies having bottoms of the same profile and dimensions were made of aluminum alloy sheets thicknesses of 0.36mm, 0.38mm and 0.39mm, filled with beer and then seamed with top closures of the same profile and dimensions made of 0.29mm and 0.32mm thick aluminum alloy sheets to measure the temperature of beer at which the top closure would buckle. The results are shown in Table 1 below.

TABLE 1

| Material Thickness (can body) | 0.36mm | 0.38mm | 0.39mm |
|---|---|---|---|
| Material thickness (top closure) | | | |
| 0.29mm | 67.5° C. | 67.0° C. | 66.0° C. |
| 0.32mm | 77.8° C. | 77.5° C. | 76.8° C. |

As seen from this table 1, the top closure seamed to a can body with 0.39mm thick bottom which distends due to the internal pressure, though such distension is smaller than that of 0.36mm thick bottom, i.e., the increase of internal volume of a can with 0.39mm thick bottom is smaller than that of a can with 0.36mm thick bottom, buckles at a lower temperature than the temperature where a top closure of same profile, dimensions and thickness seamed to a can body with 0.36mm (or 0.38mm) thick bottom which causes a larger increase of the internal volume than a 0.39mm thick bottom does. Also as is shown in the table, a 0.29mm thick top closure, for example, seamed to a can body with 0.39mm thick bottom buckled at 66° C. In order to obtain a suitable can whose top closure and bottom do not buckle at such temperature, the inventor adopted a new approach to increase the thickness of top closure which buckles, that is to say, so far as the above example is concerned, to reduce the thickness of the bottom which did not buckle at 66° C. so as to enable the bottom to distend more largely, which consequently decreases the internal pressure to an extent that the buckling resistant strength of the top closure withstands the pressure. If the top closure still buckles at the reduced internal pressure while the bottom does not buckle, the thickness of the bottom wall can be further reduced. In this manner, the wall thickness of both the bottom and the top closure can be reduced enough to meet the necessary buckling resistant strength, i.e., where both the bottom and top closure do not buckle at the specified temperature. In this manner, there can be produced a can of reduced weight that meets the aforementioned requirements, serving the purpose of material conservation at the same time. This is the second finding which formed the basis of the present invention.

The D&I can body of this present invention is a can which features a bottom that distends by influence of the internal pressure in the can, still maintaining the capability of standing in a stable upright position at normal temperature. Several sample cans manufactured by the present inventor are given below by way of further explanation of the invention.

EXAMPLE 1

In the case of beer cans, they are placed upright on a conveyor and transferred in many rows and lines during the pasteurizing process. If a single can topples over during the process, it may tip surrounding cans over and thus transfer of the cans from the conveyor to the subsequent process may be hampered. For this reason, the cans on the conveyor may slightly incline but should never topple over. The following can was manufactured as an example of the cans which satisfy the aforementioned condition. The body of this D&I can, having a bottom which is formed into the profile illustrated in FIG. 10, was manufactured from T-1 tinplate of 0.28mm in thickness, the diameter of the body being approximately 66mm, the thickness of the straight side wall being approximately 0.09mm, and the wall thickness of the bottom being 0.28mm and equivalent to the original thickness of the material. The radius R1 of the arc of the first annular ridge portion 25 of the outer peripheral portion was approximately 1.5mm, the angle $\theta$ of inclination of the inclined wall 26 was approximately 25°, the radius R2 of the arc of the second annular ridge portion 27 was approximately 1mm, the height H5 from the can end plane b to the outer surface of the peak 29 of the second annular ridge portion 27 was 6.6mm, the diameter d of the central flat portion 28 was approximately 50mm and the height S from the can end plane b to the outer surface of the central portion 28 was 4.0mm. The top closure was made in the same profile as that in FIG. 1 from a H-19 aluminum alloy sheet of 0.32mm in thickness.

The can was filled with beer of 2.4 G.V.

When this can was subjected to a pasteurizing process at 65° C., the central portion of the bottom distended by approximately 4mm, but there occured no toppling-over of the can on the conveyor, and the internal pressure at that time was approximately 5.5 kg/cm$^2$ (in the case of a bottle, the internal pressure during the above process is 6.6 kg/cm$^2$). The center of the central portion of the top closure distended approximately 2.1mm.

When the can was filled with water instead of beer and the internal pressure was increased from 5.5 kg/cm$^2$ to 6 kg/cm$^2$, the center of the central portion of the bottom distended by approximately 4.3mm protruding outside the can end plane, and the center of the top closure distended by approximately 2.4mm also protruding outside the other can end plane. However, neither the bottom nor the top closure buckled. In the course of further increase in the internal pressure to 6.5 kg/cm$^2$, either the top closure or the bottom buckled.

When the can was cooled down to normal temperature after the pasteurization, wht whole bottom central portion stayed inside the can end plane.

The can body was made of a material (0.28mm) thinner than the material used for a conventional tinplate D&I can (0.34mm) shown in FIG. 1 and the top closure was made of a material (0.32mm) thinner than the material for the conventional top closure (0.34mm). Therefore, the above mentioned can which is a combination of the can body and the top closure of this example has realized a significant reduction in weight over the conventional can. The profile, but not the dimensions of the bottom illustrated in FIG. 10 as well as the profile of the top closure illustrated in FIG. 1 are known.

However, the object of the present invention is not to determine a profile itself but to realize reduction in weight of the can or can body. Considering the fact that in a can whose internal volume increases under internal pressure, the internal pressure goes down below the internal pressure (A) produced in a bottle, the D&I can or can body of the present invention is provided with such buckling resistant strength that withstands the internal pressure (B), which is the reduced pressure in the can, plus an extra safety pressure factor of less than 0.5 kg/cm$^2$ (the extra safety pressure is calculated in consideration of various factors such as increase in the internal volume of the can after sealing, volume of filled beverage, G.V. in filling, variation in temperature, and others). The aforementioned buckling resistant strength is obtainable by using adequate profile, dimensions and wall thickness of the bottom and the top closure as one skilled in the art would in light of the teaching herein, readily determine.

As a result, the can body of the present invention can be provided with a thinner bottom wall and thus can be made lighter than the conventional can whose bottom is provided with such buckling resistant strength that withstands the aforementioned maximum allowable pressure for a bottle when the bottom of the both can bodies is otherwise identical in the profile and dimensions. Furthermore, when the profile of the bottom of the can body of the present invention is similar to that of the conventional can and the wall thickness of the bottom of the both can bodies is the same, for example, the height of the outer peripheral portion of the bottom of the can body of the present invention, which bottom is provided with such buckling resistant strength that withstands the internal pressure (B), which is lower than the internal pressure in a bottle (A), plus extra safety pressure, can be made lower than that of the conventional can whose bottom is provided with such buckling resistant strength that withstands the internal pressure in the bottle (A) plus extra safety pressure of less than 0.5 kg/cm$^2$ (maximum allowable pressure for a bottle), and accordingly, the can body of the present invention can be made lighter in weight than the conventional can.

EXAMPLE 2

A D&I can, whose can body is provided with the bottom illustrated in FIG. 12 and whose top closure is formed in the profile illustrated in FIG. 11, has the specifications given below.

| | |
|---|---|
| Diameter of can | Approx. 66mm |
| Height of can | Approx. 122mm |
| Thickness of material | T-4 tinplate, 0.32mm thick |
| Thickness of side wall | 0.09mm |
| Dimensions of each portion of bottom | |
| First annular ridge portion | R3 1.8mm<br>R4 0.9mm |
| Angle of inclined wall | $\theta$ 20° |
| Second annular ridge portion | R5 0.75mm<br>R6 0.8mm |
| Height of outer peripheral portion | $H_o$ 4.3mm |
| Height of central portion | $S_o$ 3.3mm |
| Height of center of central portion | $T_o$ 4.4mm |
| Diameter of central domed portion 88 | d Approx. 40mm |
| Diameter of seamed portion of top closure | Approx. 66mm |
| Material of top closure | H-19 aluminum alloy sheet, 0.32mm thick |
| Dimensions of each portion of top closure | |
| Radius of bead portion | r1 0.7mm |
| Countersunk | $l_1$ 6.3mm |
| Radius of the portion connecting the bead portion and central portion 93 | r2 0.6mm |
| Depth of central portion | $l_2$ 4.4mm |
| Depth of the tab | $l_3$ 1.8mm |

The weight of this D&I can is 34.9 gr., on the average, that is 2.8 gr. lighter than the conventional D&I can which is made of a 0.34mm thick material. Plural numbers of the D&I can body of this example were filled with beer of 2.3 G.V. by a usual method, seamed with a top closure, and heated. Internal pressure in the cans and displacement dimensions of the center of the central portion of the bottom and the top closure of the cans at the different heating temperatures are shown in table 3.

Table 3

| Temperature (° C.) | Internal Pressure k(kg/cm$^2$) | Average of n = 5 Displacement dimensions (mm) Top closure | Bottom |
|---|---|---|---|
| 30 | 2.4 | 1.2 | 1.45 |
| 50 | 3.8 | 1.45 | 2.05 |
| 60 | 5.05 | 1.7 | 3.05 |

Neither the bottom nor the top closure of the cans of this example buckled during pasteurizing processing, but either the bottom or the top closure of the majority of the cans buckled before the internal pressure in the cans reached 6.0 kg/cm$^2$. The cans of this example also stood in a stable upright position at normal temperature, and did not buckle at maximum allowable pressure for the can of this particular example. When the internal pressure was further increased, however, either the bottom or the top closure buckled before the internal pressure reached the maximum allowable pressure for a bottle.

The bottom and the top closure of the can of this example are provided with nearly equal buckling resistant strength and the can does not topple over during a normal pasteurizing process. Thus, the D&I can of this example embodies the object of the present invention.

EXAMPLE 3

Figure 11:
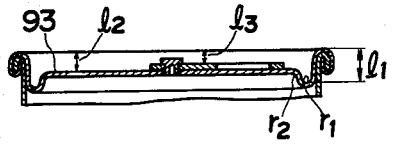
FIG. 11 is a cross sectional elevation showing a top closure having a flat central portion adopted to a specific example of the present invention in which the top closure is seamed to the opening end of the can body.

A D&I can provided with a bottom as shown in FIG. 12 and seamed with a top closure as shown in FIG. 11, has dimensions as follows:

| | |
|---|---|
| Diameter of Can | Approx. 66mm |
| Height of Can | Approx. 122mm |
| Material of Can Body | H-19 aluminum alloy sheet, 0.36mm thick |
| Thickness of Side Wall | 0.13mm |
| Thickness of Bottom Wall | 0.36mm |
| Dimensions of Bottom; | |
| First Curved Turning Portion | R3 2.3mm<br>R4 0.9mm |
| Angle of Inclined Wall | 8° |
| Second Curved Turning Portion | R5 1.3mm |
| Portion connecting the Second Curved Turning Portion and Central Portion | R6 0.8mm |
| Height of Outer Peripheral Portion | Ho 6.7mm |
| Height of Central Portion | So 3.1mm |
| Height of the Center | t0 4.2mm |
| Material of Top Closure | 0.31mm thick aluminum sheet |
| Dimensions of Top Closure; | |
| Countersunk | $l_1$ 6.3mm |
| Radius of Bead Portion | r1 0.7mm |
| Portion connecting the bead Portion and Central Portion | r2 0.6mm |
| Depth of Central Portion | l2 4.4mm |
| Depth to Tab | l3 1.8mm |

A plural number of cans were filled with beer with 2.3 G.V. in a normal method and seamed with the top closures and then were subjected to a pasteurizing process at 65° C. The displacement of the centers of the bottom and the top closure immediately after the pasteurizing process were as follows:

Displacement of the Center of Bottom $\overline{X}$ = 4.7mm

Displacement of the Center of Top Closure $\overline{X}$ = 2.6mm

It was known from the above that the center of the bottom distended by approximately 0.5mm outside of the can end plane and the top closure by approximately 0.8mm. However, none of the cans toppled while travelling on the conveyor in the pasteurizing process. The internal pressure in the can was 5.2 kg/cm$^2$ on the average while the can was undergoing pasteurization, and the buckling resistant strength of the bottom was 5.7 kg/cm$^2$ on the average and that of the top closure was 5.8 kg/cm$^2$ on the average. The weight of this can was 17.41 gr. on the average which was approximately 7% lighter than the conventional can (made of 0.43mm thick sheet).

Cans filled with pressurized gas-containing beverage are transported normally by vehicles for distribution and may be heated up to around 50° C. during such transportion in midsummer, which may cause the central portions of the bottom and/or the top closure to distend outside of the can end plane, and furthermore markings such as the date of filling, etc. stamped with ink on such distended central portions may be rubbed off by the opposing surface of the packing case containing such cans due to vibration during the transportation. Given below is an example of the can which was made based on the present invention in order to avoid such problems.

Figure 14:
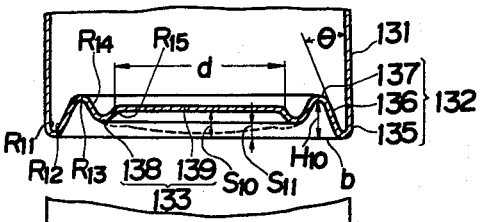
FIG. 14 is an elevational view in cross section showing the profile of a bottom of a can adopted to another specific example of the present invention.
Figure 15:
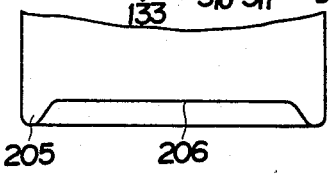
FIGS. 15 to 18 are schematic representations showing examples of the profile of the turning portion of the bottom peripheral portion of a can of the invention.
Figure 16:
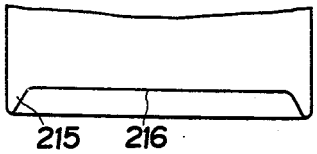
Figure 17:
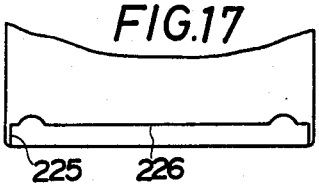
Figure 18:
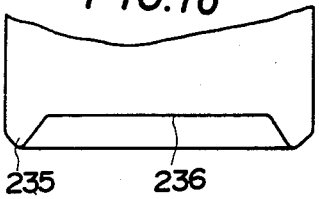
Figure 19:
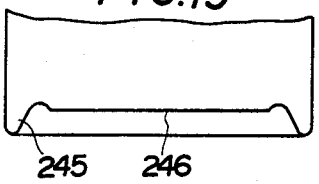
FIGS. 19 and 20 are schematic representations showing examples of the profile of the inclined wall of the bottom peripheral portion of a can of the invention.
Figure 20:
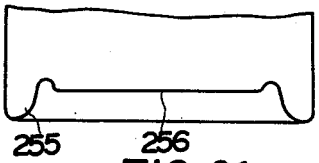
Figure 21:
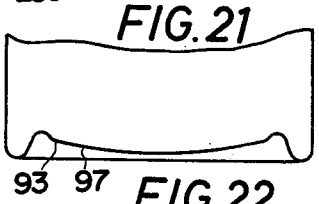
FIGS. 21 to 24 are schematic representations showing examples of the profile of the bottom central portion of a can of the invention.
Figure 22:
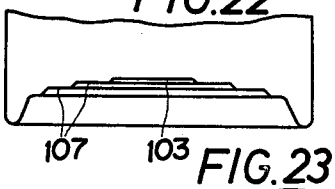
Figure 23:
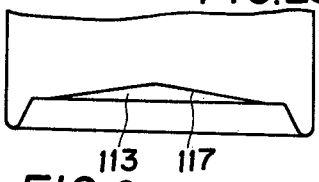
Figure 24:
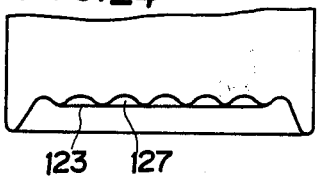

A D&I can having a can body seamed with the top closure shown in FIG. 11 is provided with a bottom as shown in FIG. 14. Said bottom has the outer peripheral portion 132, comprising the first curved turning portion 135 which is an extension of the lower end of the straight side wall 131 and turns upwardly, the inclined wall 136 which extends upwardly and nearly tangentially from the said first curved turning portion 135 toward the can longitudinal axis and the second curved turning portion 137 which is an extension of said inclined wall 136, and the bottom central portion, comprising the peripheral grooved portion 138 which is an extension of the second turning portion 137 and extends upwardly toward the can longitudinal axis, forming a shallow groove, and the flat portion 139 surrounded by said peripheral grooved portion 138. The dimensions of this can are given below.

| | |
|---|---|
| Diameter of Can | Approx. 53mm |
| Height of Can | Approx. 133mm |
| Material of Can Body | −1 tinplate, 0.32mm thick |
| Thickness of Side Wall | 0.09mm |
| Dimensions of Bottom; | |
| First curved turning portion | R11 1.6mm<br>R12 1.6mm |
| Angle of inclined wall | 26° |
| Second curved turning portion | R13 1.1mm |
| Third turning portion | R14 4.8mm<br>R15 2.1mm |
| Height of peripheral portion | H10 4.4mm |
| Height of central portion | S10 4.6mm |
| Height of third turning portion | S11 3.5mm |
| Diameter of central flat portion | d 21mm |
| Dimensions of Top Closure; | |
| Diameter of seamed portion | Approx. 53mm |
| Radius of bead portion | r1 0.7mm |
| Depth of countersunk | $l_1$ 6.1mm |
| Radius of the portion connecting bead portion and central portion | r2 0.8mm |
| Depth of central portion | $l_2$ 4.7mm |
| Depth to tab | $l_3$ 2.5mm |

A plural number of the cans in this Example 4 filled with pressurized gas-containing beverage with 3.0 G.V. were heated up to 55° C. with no buckling on either the bottom or the top closure. However, the top closure and/or the bottoms buckled in a similar number of cans when they were heated up to 60° C. The average buckling resistant strength of the bottom was 7 kg/cm$^2$ and that of the top closure was 6.9 kg/cm$^2$ which could be considered nearly equal to that of the bottom. The displacement before buckling occurred, was approximately 4.1mm at the center of the bottom and approximately 2.4mm at the center of top closure. The internal pressure in the cans at 50° C. was approximately 0.3 kg/cm$^2$ lower than that in a filled bottle (approx. 6 kg/cm$^2$), and when the central portion of the bottom and the top closure stayed inside of the can end plane under the pressure. The average weight of the D&I cans in this Example was 22.5 gr. which was 0.25 gr. less than that of the conventional D&I can.

In view of the above, if the average internal pressure in the can in this Example at the specified maximum temperature of the beverage is within the range from 6.4 kg/cm$^2$ to 6.6 kg/cm$^2$ and also if the can is used for the beverage whose extra safety pressure is in the range from 0.5 kg/cm$^2$ to 0.3 kg/cm$^2$, such a can satisfies all the requisites which the can of the present invention should be provided with and meets the condition that the central portions of the bottom and the top closure do not distend outside of the can end plane at 50° C.

EXAMPLE 5

A D&I can, like the D&I can in Example 4, provided with a combination of the bottom in FIG. 14 and the top closure in FIG. 11 has the dimensions given below.

| | | |
|---|---|---|
| Diameter of can | Approx. 55mm | |
| Height of can | Approx. 122mm | |
| Material of can body | H-19 aluminum alloy sheet 0.36mm thick | |
| Thickness of side wall | 0.135mm | |
| Dimensions of each portion of bottom | | |
| First curved turning portion | R11 2.0mm | |
| | R12 1.2mm | |
| Angle of inclination of inclined wall | $\theta$ 3° | |
| Second curved turning portion | R13 1.2mm | |
| Third curved turning portion | R14 4.5mm | |
| | R15 2.9mm | |
| Height of outer peripheral portion | H10 6.8mm | |
| Height of central portion | S10 6.7mm | |
| Height of third turning portion | S11 5.5mm | |
| Diameter of central flattened portion | d 25mm | |
| Material of top closure | H-19 aluminum alloy Sheet, 0.32mm thick | |
| Diameter of seamed portion | Approx. 53mm | |
| Radius of bead portion | r1 | 0.7mm |
| Depth of countersunk | $l_1$ | 6.3mm |
| Radius of the portion connecting bead portion and central portion | r2 | 0.8mm |
| Depth of central portion | $l_2$ | 5.1mm |
| Depth to tab | $l_3$ | 3.0mm |

When a plural number of the cans in this Example 5, filled with beverage of 3.0 G.V. and seamed with the top closures thereto, were heated up to 50° C., the internal pressure in the cans was 5.7 kg/cm$^2$ on the average, which was lower than that in a bottle by 0.3 kg/cm$^2$. The displacements of each center of the bottom and the top closure were 4.3mm and 2.1mm respectively, with no protrusion outside the can end plane. Accordingly, the cans stood in a stable upright position at normal temperature. The buckling resistant strength of both the bottom and the top closure was 7.4 kg/cm$^2$, and either the bottom or the top closure buckled before being heated up to 65° C. Therefore, if the average internal pressure in the can in this Example at the specified maximum temperature of the beverage is within the range from 6.9 kg/cm$^2$ to 7.2 kg/cm$^2$ and if the can is used for a beverage which has an extra safety pressure within the range from 0.5 to 0.2 kg/cm$^2$, such a can satisfies the requisites which the can of the present invention should be provided with, with no protrusion of the central portions of both the bottom and the top closure outside of the can end plane at 50° C.

Figure 25:
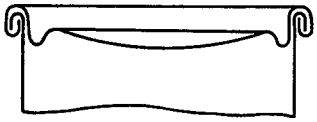
FIG. 25 is a schematic representation showing an example of the profile of the top closure central portion of a can of the invention.

Besides the profiles in the specific examples mentioned above, there are various possible applications of the profile of the bottom of the can body of the present invention as shown in FIGS. 15–24. The top closure for such forms of cans can be, for example, of a shallow convexly domed shape (FIG. 25), besides being flat in the central portion or of a shallow cancavely domed shape, and also is not limited to the easy opening type closure. The can body and the top closure materials are not limited to use of aluminum alloy sheet and tin plate, and other metal sheets for cans, for example, black plate, chemically treated steel, plastic laminated metal plate and others can also be used.

In addition to U.S. Pat. No. 3,904,069 discussed before, other art pertinent to the present invention includes U.S. Pat. Nos. 3,905,507; 3,105,765; 1,987,817; 3,693,828; and 2,894,844 and Japanese Utility Model Specification No. Sho 51–519. While such art teaches that container end walls may be made flexible to account and compensate in the structure for pressure conditions both inside and outside the container, and while such action as occurs, e.g., in the can disclosed in U.S. Pat. No. 1,987,817 may serve to reduce pressure within the container, such art neither recognizes nor suggests that reduction in pressure allows for reduction in the buckling resistant strength of the end wall structure. Such prior art can ends are designed to have a buckling resistant strength which does not take into account the effect of reduced pressure.

As those skilled in the art will readily appreciate, the can of the present invention is a significant improvement in can construction and allows for substantial savings in the amount of metal stock required for producing such cans. The invention makes use of the fact that by increasing the volume in a can by employing pressure distensible walls, there is produced a corresponding reduction in pressure in the can. Thus the can wall end closure need only be designed, i.e., given a buckling resistance to withstand not the level of pressure as would exist if no volume increase occurred, but rather the actual pressure in the can which is of a lower value. Therefore, the can end closures can be designed with suitable profile, dimensions and wall thickness of the closure walls to take into account this advantage and thus use less material in making a can for the same service as conventional D&I cans. To further illustrate the invention, consideration is had of the packaging of beer in a conventional D&I can as compared to a can made in accordance with the present invention. When beer is pasteurized, it is heated to say, for example, 65° C. This results in creation within a bottle (wherein no expansion is possible) of a pressure of predetermined magnitude, i.e., on the order of 6 kg/cm$^2$. A safety margin of 0.3 kg/cm$^2$ is designed into the bottle, so the same will withstand a pressure of 6.3 kg/cm$^2$. A conventional D&I can used for the same purpose is also designed to withstand the same pressure value although there may in fact occur within such D&I can a distension of an end closure wall and pressure reduction. Thus the D&I can of conventional construction is designed with a buckling resistant strength of about 6.3 kg/cm$^2$ in mind. A can of the present invention takes into account, however, that during pasteurization, if the end wall closure distends there will be a limitation of the pressure generated by virtue that the can volume increase so that the actual pressure produced in the can is, e.g., of a lower value on the order of 5.3 kg/cm$^2$. Thus, the can need only be designed to give the closure wall peripheral portion a buckling resistant strength sufficient to withstand that pressure plus a safety factor of up to an additional 0.5 kg/cm$^2$. The result is that material savings can be achieved by reducing the wall thickness of the closure wall, the height of the wall outer peripheral portion or the like.

It will be apparent that various changes may be made in the form and construction of the article without departing from the spirit and the scope of the invention or sacrificing all of its material advantages, the forms hereinbefore described being merely preferred embodiments thereof.

What is claimed is:

1. A lightweight can used for containing products such as beer, carbonated soft drinks and the like which contained products subsequent to sealing of the can are subjected to environmental conditions which are capable of causing generation of pressures up to a magnitude of a predetermined value within said can, said can including a can body having a bottom closure wall made integral with a straight side wall and a top closure wall at the opening end of said can body, said bottom closure wall comprising an outer peripheral portion including a first curved turning portion which is an extension of the lower end of the straight side wall and turns inwardly and upwardly and defines a standing base for said can body, an inclined wall which extends upwardly and nearly tangentially from the said first curved turning portion toward the can longitudinal axis and a second curved turning portion which is an extension of said inclined wall, and turns downwardly, and inwardly said bottom wall further having a central portion comprising a peripheral grooved portion which is an extension of the second turning portion and extends upwardly and forms a shallow groove, and a substantially flat central part surrounded by said peripheral grooved portion, said central portion being flexible and gradually distending under the influence of pressures generated in said can to gradually increase the internal volume thereof and correspondingly limit the pressure generated within the can to a value at least 0.3 kg/cm$^2$ less than said predetermined magnitude, the outer peripheral portion of said bottom wall having a buckling resistant strength at least sufficient to withstand the pressure of said lower reduced value but not sufficient to withstand said pressure of predetermined magnitude, the flexibility of said central portion being such as to limit the distension thereof under the influence of pressure in said can at normal temperature conditions to displacement of said central part axially downwardly past said shallow groove a distance in which said central part does not extend beyond the end plane of said can defined by said standing base, the thickness of said outer peripheral portion being at least 0.01 mm less than the corresponding portion would have in a can made of the same material and similar shape but is provided with a buckling resistant strength sufficient to withstand said pressure of predetermined magnitude.

2. A can in accordance with claim 1 in which the buckling resistant strength of said bottom closure wall peripheral portion is sufficient to withstand a certain pressure in excess of said pressure of lower reduced value.

3. A can in accordance with claim 2 in which said certain pressure is up to 0.5 kg/cm$^2$ in excess of said pressure of lower reduced value.

4. A can in accordance with claim 1 in which the buckling resistant strength of both said bottom closure wall and top closure wall peripheral portions are of substantially equal values.

5. A can in accordance with claim 1 in which the can body side wall and said bottom closure wall are made of aluminum.

6. A can in accordance with claim 1 in which the can body side wall and said bottom closure wall are made of tinplate.

7. A can in accordance with claim 1 in which the top closure wall is provided with a readily tearing and opening tab member.

* * * * *